US006132033A

United States Patent [19]

Browning et al.

[11] Patent Number: 6,132,033

[45] Date of Patent: Oct. 17, 2000

[54] INKJET PRINT HEAD WITH FLOW CONTROL MANIFOLD AND COLUMNAR STRUCTURES

[75] Inventors: Robert N. K. Browning; Robert C. Maze; Michael B. Hager; Douglas M. Collins; Todd A. Cleland, all of Corvallis, Oreg.; Leslie A Field, Portola Valley, Calif.; Storrs T. Hoen, Brisbane, Calif.; Phillip W Barth, Portola Valley, Calif.

[73] Assignee: Hewlett-Packard Company, Palo Alto, Calif.

[21] Appl. No.: 09/385,810

[22] Filed: Aug. 30, 1999

Related U.S. Application Data

[63] Continuation-in-part of application No. 09/303,250, Apr. 30, 1999.

[51] Int. Cl.[7] ..... B41J 2/05

[52] U.S. Cl. ..... 347/63; 347/65

[58] Field of Search ..... 347/63, 65, 84–87, 347/92, 67

[56] References Cited

U.S. PATENT DOCUMENTS

| | | | |
|---|---|---|---|
| 4,931,811 | 6/1990 | Cowger et al. | 347/93 |
| 5,317,346 | 5/1994 | Garcia | 347/63 |
| 5,350,616 | 9/1994 | Pan et al. | 347/63 |
| 5,387,314 | 2/1995 | Baughman et al. | 347/65 |
| 5,450,109 | 9/1995 | Hock | 347/67 |
| 5,463,413 | 10/1995 | Ho et al. | 347/65 |
| 5,666,143 | 9/1997 | Burke et al. | 347/65 |
| 5,734,399 | 3/1998 | Weber et al. | 347/65 |
| 5,793,393 | 8/1998 | Coven | 347/65 |
| 5,815,185 | 9/1998 | Pietrzyk | 347/92 |

OTHER PUBLICATIONS

Aden, J. Stephen, et al., "The Third–Generation HP thermal InkJet Printhead," Hewlett–Packard Journal, Feb. 1994, 41–45.

Askeland, Ronald A., et al., "The Second–Generation Thermal InkJet Structure," Hewlett–Packard Journal, Aug. 1998, 28–31.

Buskirk, William A., et al., "Development of a High–Resolution Thermal Inkjet Printhead," Hewlett–Packard Journal, Oct. 1988, 55–61.

*Primary Examiner*—Safet Metjahic
*Assistant Examiner*—Juanita Stephens

[57] ABSTRACT

An ink jet print head with a substrate defining an ink aperture. A number of ink energizing elements are located on the major surface of the substrate. A barrier layer is connected to the upper surface, and peripherally encloses an ink manifold. The barrier encompasses the ink aperture. An orifice plate is connected to the barrier layer, spaced apart from the substrate's major surface, enclosing the ink manifold. The plate defines a number of orifices, each associated with a respective ink energizing element. The ink manifold is an elongated chamber having opposed ends defined by end wall portions of the barrier layer. The barrier end wall portions each have an intermediate end wall portion protruding into the manifold. Columnar structures placed at predetermined locations, including locations at the end of the ink aperture, and extending from the major surface to the orifice plate control the migration of coalescing bubbles.

41 Claims, 5 Drawing Sheets

FIG. 6A
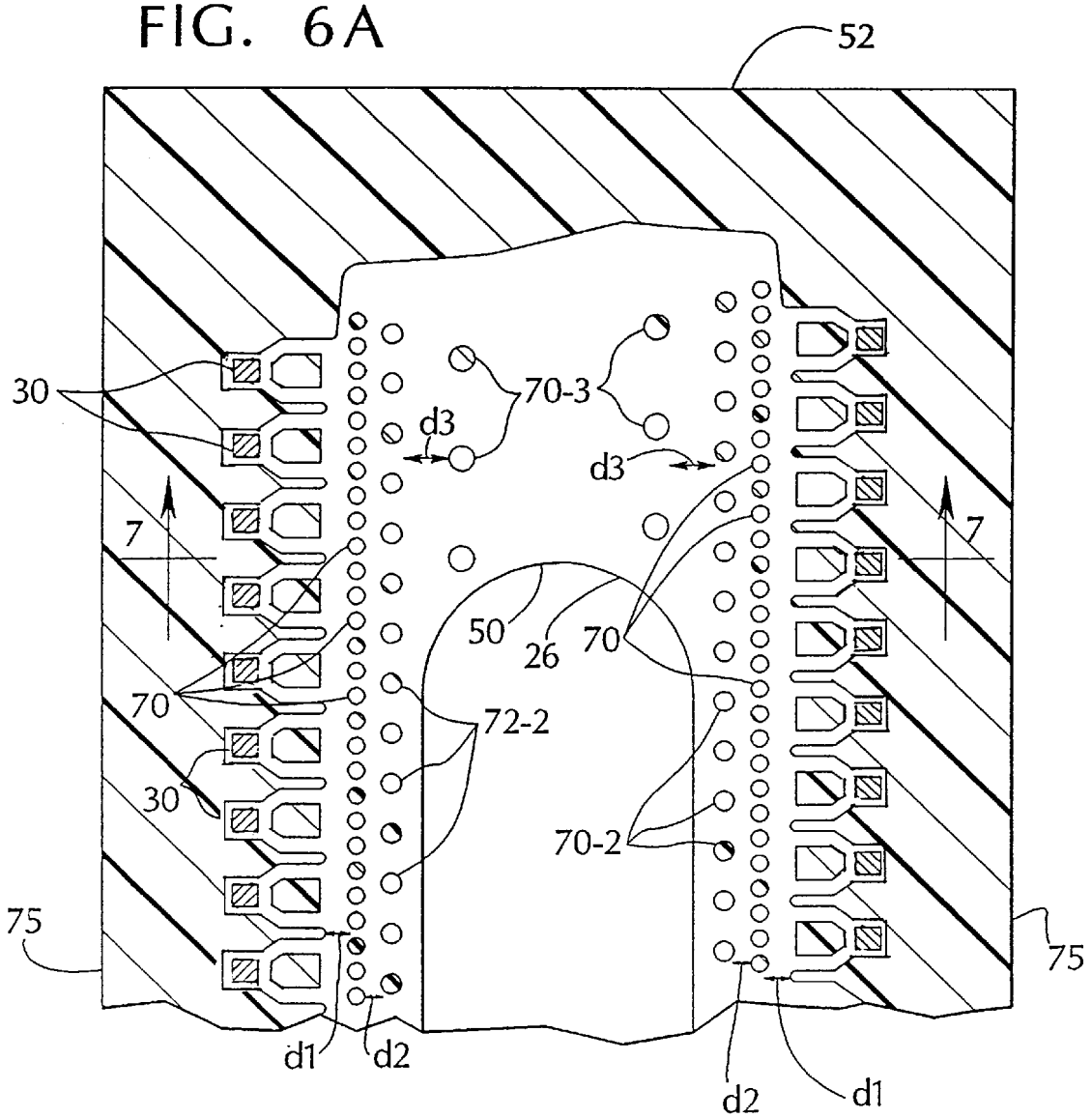
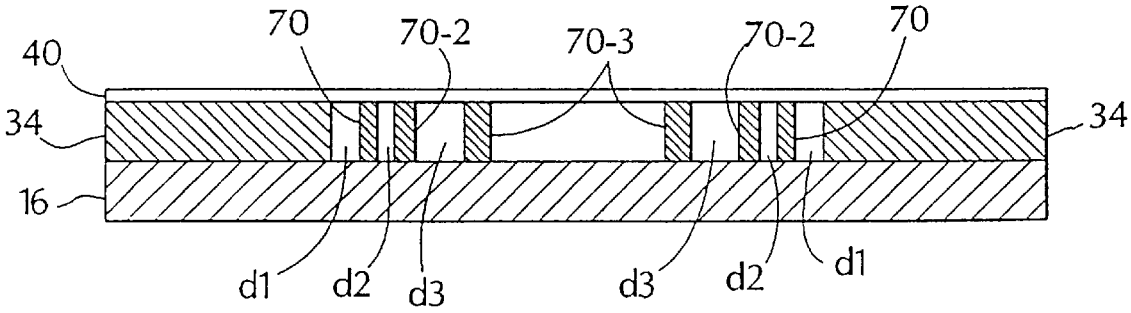
FIG. 7

INKJET PRINT HEAD WITH FLOW CONTROL MANIFOLD AND COLUMNAR STRUCTURES

This application is a continuation-in-part of U.S. patent application Ser. No. 09/303,250 filed in behalf of Maze, et al. on Apr. 30, 1999 and assigned to the assignee of the present invention.

FIELD OF THE INVENTION

This invention relates to ink jet printers, and more particularly to ink jet printers with thermal ink jet print heads.

BACKGROUND AND SUMMARY OF THE INVENTION

Ink jet printers employ pens having print heads that reciprocate over a media sheet and expel droplets onto the sheet to generate a printed image or pattern. A typical print head includes a silicon chip substrate having a central ink aperture that communicates with an ink filled chamber of the pen when the rear of the substrate is mounted against the pen. An array of firing resistors are positioned on the front of the substrate, within a chamber enclosed peripherally by a barrier layer surrounding the resistors and the ink aperture. An orifice plate connected to the barrier just above the front surface of the substrate encloses the chamber, and defines a firing orifice just above each resistor. Additional description of basic printhead structure may be found in "The Second-Generation thermal Inkjet Structure" by Ronald Askeland et al. in the Hewlett-Packard Journal, August 1988, pages 28–31; "Development of a High-Resolution Thermal Inkjet Printhead" by William A. Buskirk et al. in the Hewlett-Packard Journal, October 1988, pages 55–61; and "The Third-Generation HP Thermal Inkjet Printhead" by J. Stephen Aden et al. in the Hewlett-Packard Journal, February 1994, pages 41–45.

For a single color pen, the resistors are arranged in two parallel elongated arrays that each extend nearly the length of the substrate to provide a maximum array length for a given substrate chip size. The resistor arrays flank opposite sides of the ink aperture, which is typically an elongated slot or elongated array of holes. To ensure structural integrity of the substrate, the ink aperture may not extend too close to the substrate edges, nor as close to the edges as the endmost several firing resistors. Therefore, several resistors at each end of each array may extend beyond the end of the ink supply aperture or slot.

While a reasonably effective configuration, it has been found that the end firing elements, that is, those that include the end resistors, are more susceptible to failure than are the multitude of firing elements that adjoin the length of the ink supply slot. It is believed that small air bubbles come primarily from two sources: those that arise from outgassing of ink components during normal operation, and those left behind after completion of pen assembly. These bubbles tend to aggregate and coalesce into larger bubbles in ends of the ink chamber. This occurs in the portions beyond the ends of the ink supply slots, and in the vicinity of the end resistors. Small bubbles present are normally tolerated because they can usually be "ejected," with only a single ink droplet being omitted from printed output; the firing element then continues properly following the momentary tolerable failure. However, it is believed that when the small tolerable bubbles are permitted to coalesce, they become large enough to permanently block one or more firing elements, preventing ink from reaching a firing resistor.

In addition, the ink chamber region beyond the ends of the ink supply slot are believed to create a stagnant zone of ink, and to have a lower ink flow velocity to the endmost firing elements. An improved ink jet print head that more effectively disposes of bubbles would be an improvement over the prior art.

SUMMARY OF THE INVENTION

The present invention overcomes the limitations of the prior art by providing an ink jet print head with a substrate defining an ink aperture. A number of ink energizing elements are located on the major surface of the substrate. A barrier layer is connected to the upper or major surface, and peripherally encloses an ink manifold. The barrier encompasses the ink aperture. An orifice plate is connected to the barrier layer, spaced apart from the substrate's major surface, enclosing the ink manifold. The plate defines a number of orifices, each associated with a respective ink energizing element. The ink manifold is an elongated chamber having opposed ends defined by end wall portions of the barrier layer. The barrier end wall portions each have an intermediate end wall portion protruding into the manifold.

BRIEF DESCRIPTION OF THE DRAWINGS

FIG. 6A is a top view of an alternate embodiment of the print head shown in FIGS. 1–5 showing multiple columnar structures used to manage bubbles in the vicinity of the end resistors.

FIG. 7 is a side view of the print head shown in FIG. 6A along the section line 7–7 shown in FIG. 6A.

DETAILED DESCRIPTION OF A PREFERRED EMBODIMENT

Figure 1:
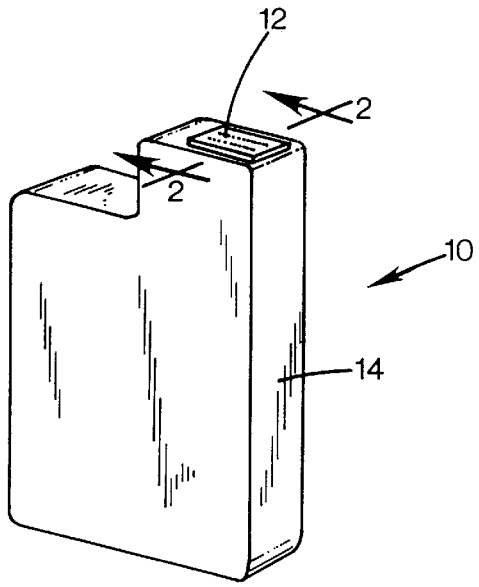
FIG. 1 is a perspective view of an ink jet pen according to a preferred embodiment of the invention.
Figure 5:
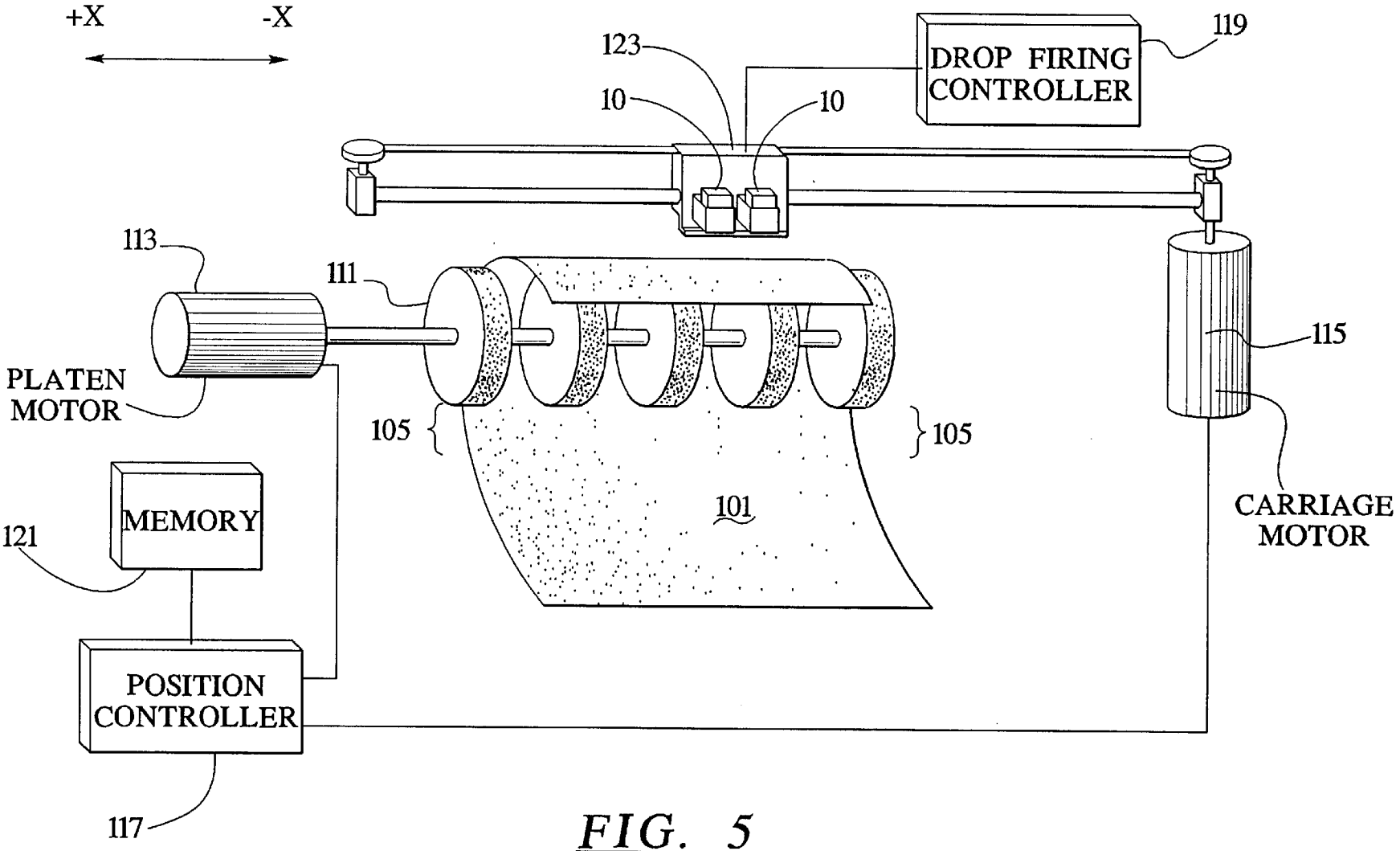
FIG. 5 is a schematic representation of a printer which may employ the present invention.

FIG. 1 shows an ink jet pen 10 having a print head 12. (FIG. 5 shows two pens 10 as part of a print head carriage 123 used to print ink onto a paper as part of a printer.) The pen 10 has a pen body 14 defining a chamber containing a supply of ink, which is supplied to the print head 12. An electrical interconnect (not shown) provides connection between a printer in which the pen 10 is installed, so that the printer may control printing by the print head 12.

Figure 2:
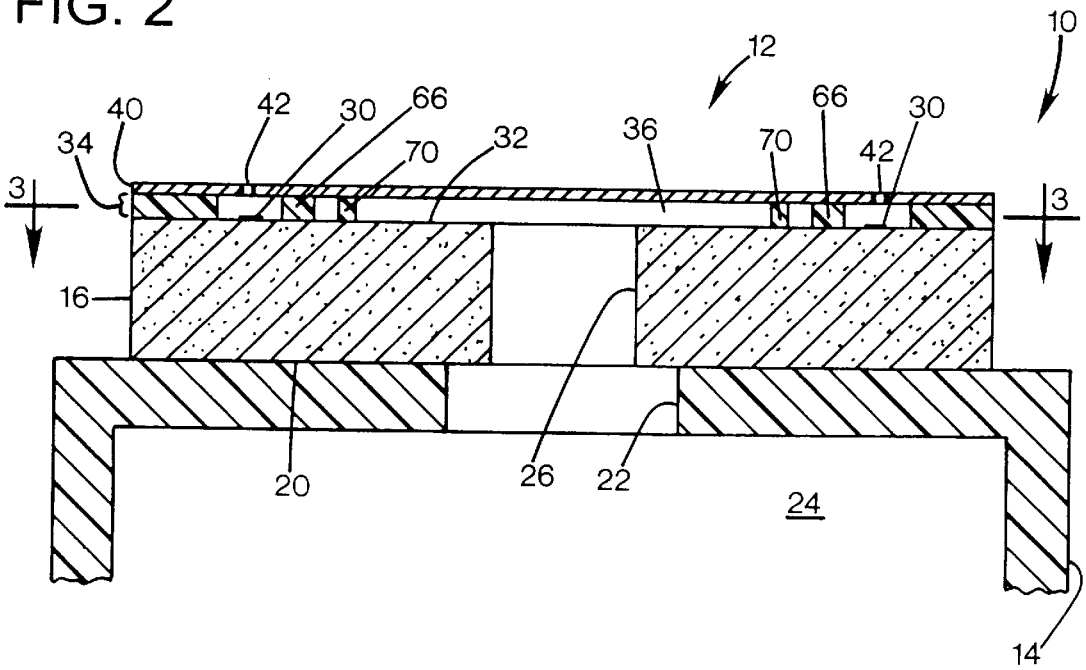
FIG. 2 is an enlarged sectional view of a print head taken along line 2–2 of FIG. 1.

FIG. 2 shows the print head 12 in cross section. The print head 12 includes a silicon substrate 16 having a rear surface 20 mounted to the pen body 14. An ink outlet 22 in the pen body opens into the ink chamber 24. The substrate 16 defines an ink aperture 26 registered with the ink outlet 22. A number of firing resistors 30 are located on an upper or major surface 32 of the substrate 16, arranged in rows on opposite sides of the ink channel 26. A barrier layer 34 is attached to the upper or major surface 32 of the substrate 16, and covers the periphery of the substrate to laterally enclose an ink manifold chamber 36, encompassing the resistors 30.

The barrier layer 34 has various features and important pattern details that will be discussed below. An orifice plate 40 is attached atop the barrier layer 34 to enclose the manifold chamber 36. The orifice plate defines arrays of ink orifices 42, each of which is registered with a respective firing resistor 30. In the preferred embodiment, the orifice plate 40 is 25 microns thick, and the barrier layer 34 is 14 microns thick, although alternatives may be used, and the drawings are not to scale.

Figure 3:
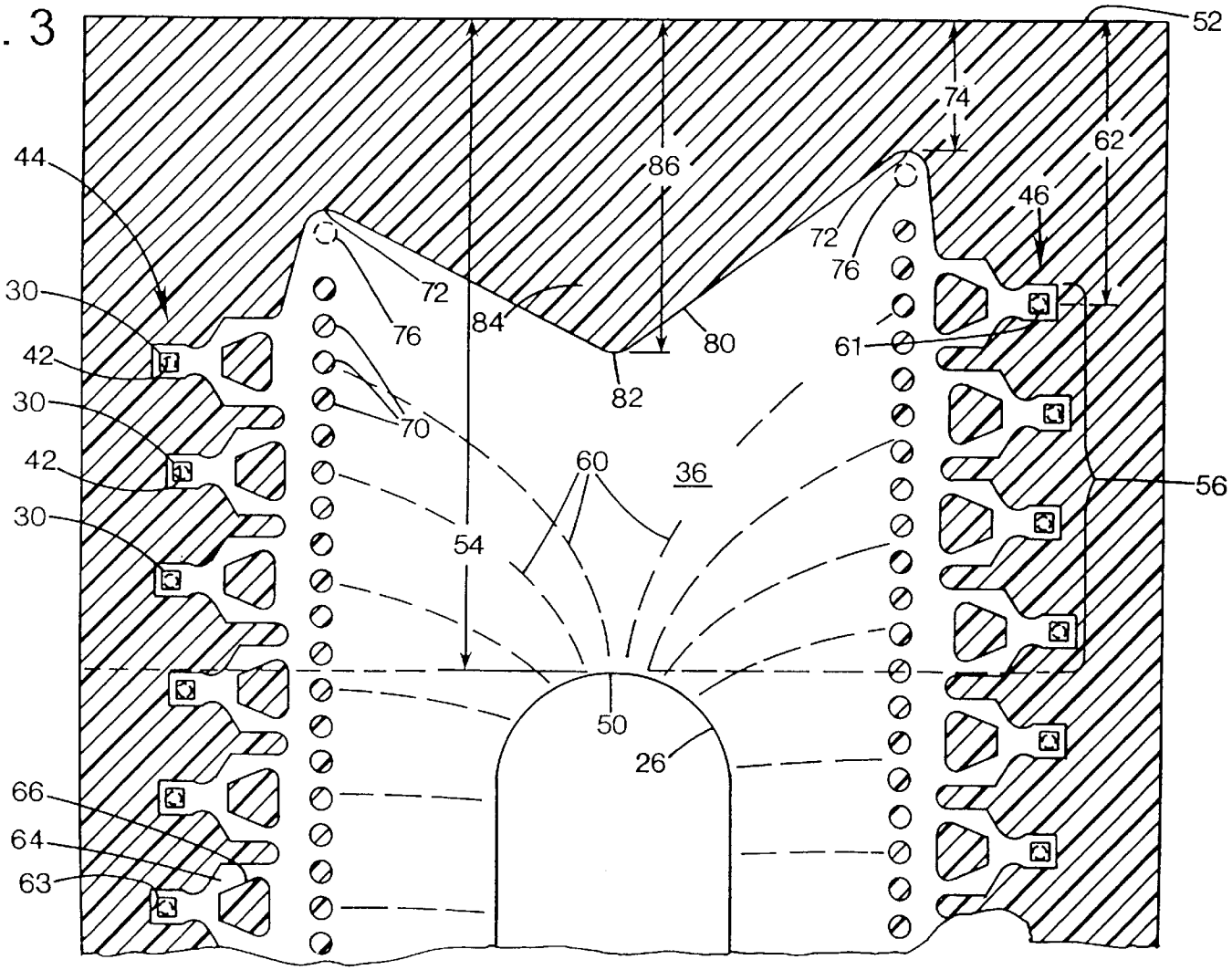
FIG. 3 is an enlarged sectional top view of a print head taken along line 3–3 of FIG. 2.

FIG. 3 shows the barrier layer 34 and substrate 16 at one end of the print head 12. The other end is the same, with numerous intermediate features repeated between the ends. The resistors 30 are arranged in a first row 44 and a second row 46, with the resistors being evenly spaced apart in each row. The rows are axially offset by one-half of the resistor spacing to provide an evenly alternating arrangement that provides a higher resolution printed swath. The ink aperture or supply slot 26 is an elongated oblong aperture in the substrate 16, with only a single end shown. In alternative embodiments, it may be an array of end-to-end oblong or circular apertures having the same total end-to-end length. The ink aperture 26 end edge 50 is spaced apart from the substrate 16 edge 52 by a slot spacing distance 54. This must be more than a minimal amount to ensure that the substrate has structural integrity against breakage and ink leakage.

An end resistor zone 56 extends beyond the end of the ink supply slot 26, and includes several resistors (in this embodiment a total of eight resistors, four per row.) These end resistors 30 do not receive ink flow from the ink aperture 26 on a direct lateral path as do the remaining resistors. The end resistors 30 receive ink flow that takes a longer path 60 having a directional component parallel to the slot axis. The most remote resistor 61 is spaced apart from the substrate edge 52 by a spacing 62. This spacing 62 is as small as possible to provide a wide swath from a given substrate 16 dimension, to minimize component costs.

The barrier layer 34 defines a firing chamber 63 for each resistor. The firing chamber 63 extends laterally away from the manifold 36, and is connected via an antechamber 64 containing a flow control wedge 66 formed as part of the barrier layer 34. The flow control wedge 66 creates tapered ink passages that provide redundant flow paths. A row of barrier pillars 70, which are formed so as to be substantially adjacent to the barrier layer, is positioned between the ink supply slot 26 and the firing chambers 63, and serves to deter passage of any contaminant particles or larger air bubbles into the firing chambers. As described more fully hereinafter with respect to FIGS. 6A and 7, the barrier pillars 70 tend to urge gas bubbles to migrate away from the firing chambers toward the ink feed slot as small bubbles coalesce to form larger bubbles.

Referring to FIG. 6A, there are shown several predetermined-diameter circles, representing the top view of several columnar structures or pillars which are identified in FIG. 6A by reference numerals 70, 70-2 and 70-3. Each of the relatively closely-spaced columnar structures forming a first row of such structures is identified by reference numeral 70. As shown in the top view, the circles represent the cross-section of columns that extend into the plane of the FIG. 6A. Each of the columnar structures 70 forming this first row is shown to be spaced from the inlet to ink channels leading to the firing resistors 30 by a distance $D_1$. Although the firing resistors are illustrated as being collinear, they may be offset by a small amount to provide higher print quality. It can be seen from FIG. 6A that the columnar structures forming the first row are formed along a line running parallel to the sides 75 of the print head 12.

FIG. 6A also shows the top view of a second row of substantially more widely spaced columnar structures that are identified in FIG. 6A by reference numeral 70-2. The columnar structures forming this second row, also lie along a line substantially parallel to the sides 75 and are separated from the columnar structures 70 of the first row by a distance $D_2$. The columnar structures of the second row 70-2 are spaced on centers that are twice the spacing between centers as the columns of the first row 70. The centers of each column of the second row lies on a line that bisects, and is perpendicular to a line passing through the centers of a pair of adjacent columnar structures in the first row.

FIG. 6A also shows the top view of yet a third row of even more widely spaced columnar structures, each of which is identified by reference numeral 70-3. Like the columnar structures of the first two rows (70 and 70-2 respectively) the columnar structures of the third row 70-3 also lie along a line substantially parallel to the sides 75 of the print head 12. The columnar structures of the third row 70-3 are spaced on centers that are twice the spacing between centers as the columns of the second row 70-2, and the centers of each column of the third row lies on a line that bisects and is perpendicular to a line passing through the centers of a pair of adjacent columns in the second row 70-2.

FIG. 7 shows the side view of the columnar structures 70, 70-2 and 70-3 as taken along section line 7—7 (shown in FIG. 6A). The columnar structures are substantially orthogonal to the substrate and in a working implementation extend to the top orifice plate 40, which is not shown in FIG. 6A.

The columnar structures 70, 70-2 and 70-3 can be formed using a variety of processes. Abrasion, plating or vapor deposition techniques might be used to form or grow the columnar structures, depending upon the dimensions desired.

The thickness of the barrier layer 34, atop which lies the orifice plate 40, substantially defines the height of the columnar structures 70, 70-2 and 70-3. The first row of columnar structures, each of which is identified by reference numeral 70, is separated from the inside edge of the barrier layer 34 by the distance $D_1$. Similarly, the distance separating the second row of columnar structures (each element 70-2) from the first row is shown as $D_2$ and the distance separating the third row (each element 70-3) is shown as $D_3$.

With respect to FIG. 6A, bubble migration in the ink manifold chamber 36 can be controlled using the columnar structures by taking advantage of the fact that bubbles tend to grow and expand into less constraining, i.e. larger volumes. It can be seen from the top view of the columnar structures 70, 70-2 and 70-3 that the distance $D_1$ is less than the distance $D_2$. Moreover, the distance $D_2$ is less than the distance $D_3$. Stated alternatively, the spacing of the columnar structure 70, 70-2 and 70-3, decreases as the structures get closer to the firing resistors 30 and increases as the structures get closer to the ink channel 26.

As bubbles tend to coalesce, they will tend to do so in the areas permitting their increasing volume albeit between the columnar structures 70, 70-2 and 70-3. It can be seen in both FIGS. 6A and 7 that the spaces between the columnar structures 70, 70-2 and 70-3 increases with distance from the firing chambers. As bubbles tend to increase by coalescing, they must begin to coalesce closer and closer to the ink channel 26, which is coupled to the ink reservoir.

Figure 6B:
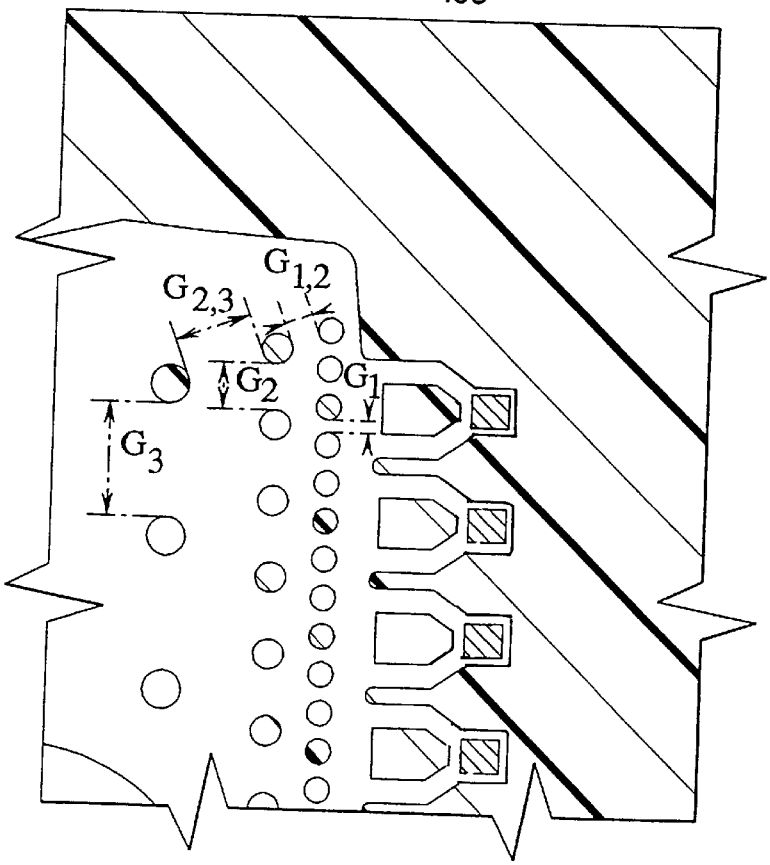
FIG. 6B is a top view depicting an enlarged section of an alternate embodiment of the print head shown in FIG. 6A.

Referring to FIG. 6B, which shows an enlarged section of FIG. 6A, the ratio of the gap between any column and its nearest neighbor and the gap between that column and its next nearest neighboring column is approximately constant for all columns. The distance between columns of the first row 70 and columns of the second row 70-2 is selected such that the gap (i.e. the shortest distance) between any column in the first row and the nearest column in the second row $G_{1,2}$ is approximately equal to the square root of the gap between columns in the second row $G_2$ times the gap between columns in the first row $G_1$. $G_{1,2}$ is expressed as follows, where G1 and G2 are as shown in FIG. 6B:

$$G_{1,2} \approx \sqrt{G2 \times G1}$$

n the preferred embodiment, the spacing between rows 70, 70-2, and 70-3, and the spacing between the individual columnar structures comprising the rows, substantially doubled from one row to the next.

In other words, the distance between the centers of elements of the second row 70-2 was 56 $\mu$m, twice the distance between centers of elements of the first row 70, which was 28 $\mu$m. The distance between centers of elements of the third rows, 70-3 was approximately 113 $\mu$m, approximately twice the distance between centers of elements of the second row. Furthermore, the distance between the centerline of the second row 70-2 and the centerline of the third row 70-3 was 38 $\mu$pm; approximately twice the distance between the centerlines of the first and second rows.

In the preferred embodiment, column diameter of columns in the first row 70 was approximately 18 microns; columns in the second row 70-2 were approximately 22 microns in diameter; columns in the third row were approximately 26 microns in diameter. The ratio of diameters of the first and second row was 0.82. The ratio of diameters of the second and third rows was approximately 0.85. In general, the ratio of the diameter of columns in any given row to the diameter of columns in an adjacent row is preferably constant with the value of that ratio being between 0.5 and 1.0.

In instances where the ratio of diameters of columns of adjacent rows is held to be exactly equal to 0.5, then the ratio of column gaps can be held to be exactly equal to the square root of two, resulting in a true fractal pattern in which subsets of the pattern are identical to other subsets after proper scaling. This design is not preferred however because the resulting large-diameter columns in the second, third and subsequent rows may impede fluid flow.

Alternate embodiments of the invention would of course include variations in these distances. Similarly, alternate embodiments of the invention of course include more or less than three (3) rows of columnar structures. Furthermore, while the columnar structures shown in FIGS. 6A and 7 are arranged along substantially parallel lines, each of which is substantially parallel to the side 75, still other embodiments of the invention would contemplate non-linear arrangements of columnar structures arranged in sets of various geometrical arrangements, perhaps even pseudo-random placement of sets of closely spaced columns adjacent to a set of more widely spaced columns. Such alternate placements of columns are not considered to be optimal because random, pseudo random or other geometric placements do not readily accommodate the increased bubble sizes caused by coalescing. In general the placement, arrangement and spacing of the columnar structures is subject to the limitation that the spacing between sets of structures generally increase as the sets of structures get further from the firing resistors and closer to the ink aperture 26 in order to keep the migration of coalescing bubbles moving toward the ink aperture 26, and, preferably back to the ink reservoir. The columnar structures, alone or in combination with the aforementioned flow control wedge 66, can substantially augment bubble movement control in an ink jet cartridge wherein bubbles need to be routed to, or away from a particular area.

A relatively new development in ink-jet print head technology is the development of orifice or top plate 40 as part of, or integrally with, the barrier layer 34. In such an embodiment, the columnar structures would also be formed at the time that the barrier layer 34 and the orifice plate 40 is formed. For claim construction purposes, such a combined structure is referred to herein as an orifice-barrier layer having a barrier layer 34 such as that shown in FIG. 7 and an orifice layer 40, also such as the one shown in FIG. 7.

With respect to FIG. 3, at the end of the manifold chamber 36 along each major edge defined by the pillars 70, the manifold terminates in corners 72. The most remote corner extends to within a spacing 74 from the substrate edge 52, and each corner encompasses an optional non-firing orifice 76 in the orifice plate above, so that air trapped may be released from the manifold chamber 36. The spacing 74 is minimized to provide efficient substrate usage as noted above, and is limited by tolerances and the need for a minimum width of barrier material to ensure the integrity of the manifold chamber 36 seal.

At the ends of the manifold chamber 36, the barrier layer 34 forms an end wall 80 that protrudes inwardly into the manifold chamber 36 at a central vertex 82. Thus, a wedge 84 of barrier layer 34 material extends into the manifold chamber 36. The vertex 82 of the wedge 84 is spaced apart from the substrate edge 52 by a spacing 86, which is greater than the end resistor spacing 62. The vertex 82 protrudes sufficiently to intervene between the endmost resistors of each row, and extends beyond the manifold corners 72 by a distance (equal to spacing 86 minus spacing 74) of about four times the pitch of the resistors. The vertex 82 protrudes toward the slot end 50 to narrow that distance (measured by spacing 54 minus spacing 86) to less than two-thirds of what it would be if the end wall 80 extended straight between the manifold chamber 36 corners 72.

By occupying part of what would have been a vacant manifold chamber 36 portion, the protrusion or wedge 84 fills a location where ink flow would have been slow or stagnant, and where small bubbles may have aggregated and coalesced. By eliminating this stagnant region, the remaining manifold chamber 36 regions are continually flushed by the ink supply as the resistors 30 fire. This further prevents any air bubbles that may normally arise from coalescing into large air bubbles that would otherwise begin to fill the manifold ends, and eventually block some of the end nozzles. In addition, by forcing a reduced path length to the end nozzles, the wedge 84 reduces the time the ink spends in the manifold chamber 36 at the ends, limiting the amount of time in which it may outgas air bubbles.

In the preferred embodiment, the print head 12 includes 144 resistors, with a spacing of $1/300^{th}$ inch or 84.67 microns between adjacent resistors 30 in a row, for an effective spacing of half that amount. The overall length of the print head 12 is 8680 microns, with a supply slot 26 length of 5690 microns, for a slot end spacing 54 of 1495 microns. The slot end spacing 54 should be no less than about 1345 microns to minimize susceptibility to cracking at the slot ends. In the preferred embodiment, there are eight resistors in the end section 56 at each end. The endmost resistor is centered at a spacing 62 of 930 microns from the substrate edge. The corner 72 of the manifold is at a spacing 74 of 815 microns from the edge, and the vertex 82 extends 970 microns from the edge.

Figure 4:
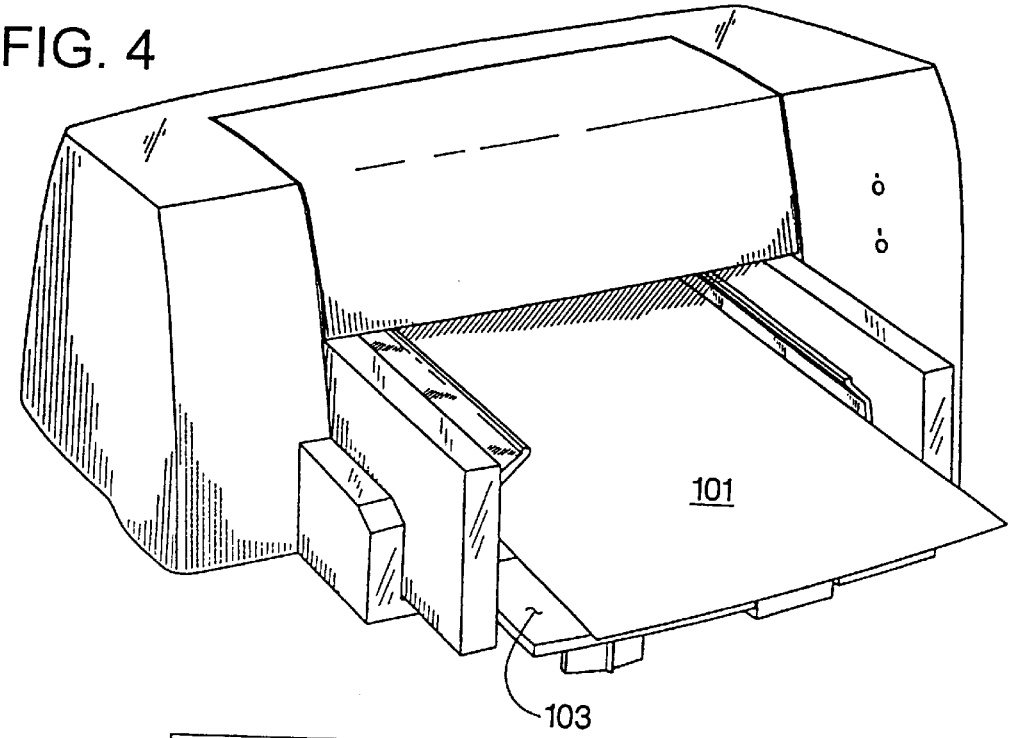
FIG. 4 is an isometric drawing of a typical printer which may employ an ink jet pen utilizing the present invention.

An inkjet printer which may employ the present invention is illustrated in the isometric drawing of a typical inkjet printer shown in FIG. 4. Paper or other media 101, which may be printed upon, is stored in the input tray 103. Referring to the schematic representation of a printer of FIG. 5, a single sheet of media is advanced from a medium input 105 into a printer print area defined essentially by the printhead of inkjet pens 10 by a medium advancing mechanism including a roller 111, a platen motor 113, and traction devices (not shown). In a typical printer, one or more inkjet pens 10 are incrementally drawn across the medium 101 on the platen by a carriage motor 115 in a direction perpendicular to the direction of entry of the medium. The platen motor 113 and the carriage motor 115 are typically under the control of a media and cartridge position controller 117. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 101 is positioned in a location so that the pens 10 may eject droplets of ink to place dots on the medium as required by the data that is input to a drop firing controller 119 of the printer. These dots of ink are expelled from the selected orifices in a printhead element of selected pens in a band parallel to the scan direction as the pens 10 are translated across the medium by the carriage motor 115. When the pens 10 reach the end of their travel at an end of a print swath on the medium 101, the medium is typically incrementally advanced by the media and cartridge position controller 117 and the platen motor 113. Once the pens have reached the end of their traverse in the X direction on a bar or other print cartridge support mechanism, they are either returned back along the support mechanism while continuing to print or returned without printing. The medium may be advanced by an incremental amount equivalent to the width of the ink ejecting portion of the printhead or some fraction thereof related to the spacing between the nozzles. Control of the medium, positioning of the pen, and selection of the correct ink ejectors of the printhead for creation of an ink image or character is determined by the controller 117. The controller may be implemented in a conventional electronic hardware configuration and provided operating instructions from conventional memory 121. Once printing of the medium is complete, the medium is ejected into an output tray of the printer for user removal. The printer's operation is enhanced by ink jet pens 10 that employ the print head 12 structures discussed above, including the flow control wedge 66 and the columnar structures used to control bubble migration.

While the above is discussed in terms of preferred and alternative embodiments, the invention is not intended to be so limited. For instance, although shown as a single printhead for a single ink color, a print head may be provided with multiple portions like that shown on a single substrate. Each may have a single ink supply slot connected to its own pen ink chamber, and flanked by rows of nozzles dedicated to that color. In addition, the end wall protrusion may have any protruding shape that reduces the manifold volume along the midline at the end, or which serves to direct ink flow on a more direct path to end nozzles.

What is claimed is:

1. An ink jet print head comprising:

a substrate defining an elongated ink aperture and having a major surface;

a plurality of ink energizing elements disposed on the major surface of the substrate;

a barrier layer connected to the major surface, peripherally defining an elongated ink manifold, and encompassing the ink aperture;

an orifice plate connected to the barrier layer, spaced apart from the substrate major surface, enclosing the ink manifold, and defining a plurality of orifices, each associated with a respective ink energizing element, the ink manifold being an elongated chamber having opposed ends defined by end wall portions of the barrier layer;

the barrier end wall portions each having an intermediate end wall portion protruding into the manifold; and at least first and second columnar structures of predetermined diameters spaced apart at predetermined distances from each other, extending substantially orthogonally from said major surface of the substrate to said orifice plate.

2. The print head of claim 1 wherein the first set of columnar structures is each separated from antechamber wedge structures by a first distance and where the second set of columnar structures is separated from said first set of columnar structures by a second distance.

3. The print head of claim 2 wherein said first set of columnar structures is arranged to substantially form a linear row of columnar structures.

4. The print head of claim 2 wherein said first set and said second set of columnar structures are both arranged to form substantially linear and parallel rows of columnar structures.

5. The print head of claim 1 further including a third set of columnar structures separated from said second set of columnar structures by a third distance.

6. The print head of claim 5 wherein said third distance is greater than said second distance.

7. The print head of claim 1 wherein the ink aperture has an end portion spaced apart from a peripheral edge of the substrate by a first amount and wherein the barrier end wall portion is spaced apart from the peripheral edge by a lesser second amount.

8. The print head of claim 1 wherein the ink energizing elements are arranged in a substantially linear array parallel to the elongated ink manifold, and wherein the array extends beyond the intermediate barrier end wall portions that protrude into the ink manifold.

9. The print head of claim 8 including two substantially linear arrays of ink energizing elements, wherein each array is positioned on opposite sides of the elongated ink aperture.

10. The print head of claim 1 wherein the barrier end walls include two flat end wall portions configured at an angle to provide a wedge shape intruding into the ink manifold.

11. The print head of claim 1 wherein the periphery of the elongated ink manifold has opposed major edges, each defining an array of extending chambers, each chamber encompassing a respective ink energizing element.

12. The ink jet print head of claim 1 further comprised of an orifice-barrier layer.

13. An ink jet print head comprising:

a substrate defining an elongated ink aperture portion having opposed ends, and the substrate having a major surface;

a plurality of ink energizing elements disposed on the major surface of the substrate in two elongated rows on opposite sides of the ink aperture;

a barrier layer connected to the major surface, and peripherally defining an elongated ink manifold encompassing the ink aperture;

a plurality of columnar structures of predetermined diameters, spaced apart from each other at predetermined distances, formed to extend substantially orthogonal from said major surface to an orifice plate;

the ink manifold being an elongated chamber having opposed ends defined by end wall portions of the barrier layer; and the rows of ink energizing elements including end elements at each end, and the barrier end wall portions each including a protrusion extending between the end element of one row, and the corresponding end element of the other row.

14. The print head of claim 13 wherein at least one row of ink energizing elements extends beyond the ends of the ink aperture.

15. The print head of claim 13 wherein the orifice plate is attached to the barrier layer to enclose the elongated ink manifold, and defining a plurality of orifices, each associated with a respective ink element.

16. The print head of claim 13 wherein the ink aperture has an end portion spaced apart from a peripheral edge of the substrate by a first amount and wherein the barrier end wall portion is spaced apart from the peripheral edge by a lesser second amount.

17. The print head of claim 13 wherein the barrier end walls include two flat end wall portions configured at an angle to provide the protrusion.

18. The print head of claim 13 wherein the periphery of the elongated ink manifold has opposed major edges, each defining an array of extending chambers, each chamber encompassing a respective ink energizing element.

19. The ink jet print head of claim 13 further comprised of an orifice-barrier layer.

20. An ink jet printer comprising:

an inkjet printhead comprising:

a substrate defining an ink aperture and having a major surface;

a plurality of ink energizing elements on the major surface of the substrate;

a barrier layer connected to the major surface, peripherally defining an ink manifold, and encompassing the ink aperture;

an orifice plate connected to the barrier layer, spaced apart from the substrate major surface, enclosing the ink manifold, and defining a plurality of orifices, each associated with a respective ink energizing element;

the ink manifold being an elongated chamber having opposed ends defined by end wall portions of the barrier layer;

the barrier end wall portions each having an intermediate end wall portion protruding into the manifold;

a plurality of columnar structures of predetermined diameters spaced apart from each other at predetermined distances, and extending substantially orthogonally from said major surface to said orifice plate;

a printhead carriage; and a printhead position controller.

21. An ink jet print cartridge comprising:

an ink reservoir;

an inkjet print head cooperatively secured to said ink reservoir comprising:

a substrate defining an elongated ink aperture through which ink from said ink reservoir flows, said substrate having a major surface;

a plurality of ink energizing elements disposed on the major surface of the substrate;

a barrier layer connected to the major surface, peripherally defining an elongated ink manifold into which ink from said ink reservoir flows, said barrier layer encompassing the ink aperture;

an orifice plate connected to the barrier layer, spaced apart from the substrate major surface, enclosing the ink manifold, and defining a plurality of orifices, each associated with a respective ink energizing element, the ink manifold being an elongated chamber having opposed ends defined by end wall portions of the barrier layer;

the barrier end wall portions each having an intermediate end wall portion protruding into the ink manifold; and at least first and second columnar structures of predetermined diameters spaced apart at predetermined distances from each other, extending substantially orthogonally from said major surface of the substrate to said orifice plate.

22. The ink let print cartridge of claim 21 wherein the first set of columnar structures is each separated from antechamber wedge structures by a first distance and where the second set of columnar structures is separated from said first set of columnar structures by a second distance.

23. The ink jet print cartridge of claim 22 further including a third set of columnar structures separated from said second set of columnar structures by a third distance.

24. The ink jet print cartridge of claim 23 wherein said third distance is greater than said second distance.

25. The ink jet print cartridge of claim 22 wherein said first set of columnar structures is arranged to substantially form a row of columnar structures.

26. The ink jet print cartridge of claim 22 wherein said first set and said second set of columnar structures are both arranged to form first and second rows of substantially linear and parallel columnar structures.

27. An ink jet print head comprising:

a substrate having a major surface and defining at least one elongated ink aperture;

a plurality of ink energizing elements disposed on the major surface of the substrate;

a barrier layer connected to the major surface, peripherally defining an elongated ink manifold encompassing said at least one ink aperture;

an orifice plate connected to the barrier layer, spaced apart from the substrate major surface, enclosing the ink manifold, and defining a plurality of orifices, each associated with a respective ink energizing element, the ink manifold being an elongated chamber having opposed ends defined by end wall portions of the barrier layer;

the barrier end wall portions each having an intermediate end wall portion protruding into the manifold; and at least first and second columnar structures of predefined diameters, spaced apart at predetermined distances from each other, and extending substantially orthogonally from said major surface of the substrate to said orifice plate.

28. The print head of claim 27 wherein each of said at least one ink aperture has a dedicated ink chamber.

29. The print head of claim 28 wherein ink in said dedicated ink chambers may be of different ink colors.

30. The print head of claim 29 wherein a predetermined set of ink energizing elements is dedicated to each at least one ink aperture.

31. The print head of claim 30 wherein the first set of columnar structures is each separated from antechamber wedge structures by a first distance and where the second set of columnar structures is separated from said first set of columnar structures by a second distance.

32. The print head of claim 31 further including a third set of columnar structures separated from said second set of columnar structures by a third distance.

33. The print head of claim 32 wherein said third distance is greater than said second distance.

34. The print head of claim 31 wherein said first set of columnar structures is arranged to substantially form a linear row of columnar structures substantially parallel to the antechamber wedge structures.

35. The print head of claim 31 wherein said first set and said second set of columnar structures are both arranged to substantially form linear and parallel rows of columnar structures.

36. The print head of claim 30 wherein at least one ink aperture has an end portion spaced apart from a peripheral edge of the substrate by a first amount and wherein the barrier end wall portion is spaced apart from the peripheral edge by a lesser second amount.

37. The print head of claim 30 wherein the ink energizing elements are arranged in a substantially linear array parallel to the ink manifold, and wherein the array extends beyond the intermediate barrier end wall portions that protrude into the ink manifold.

38. The print head of claim 30 including two substantially linear rows of ink energizing elements, wherein each row is positioned on opposite sides of the ink aperture.

39. The print head of claim 30 wherein the barrier end walls include two flat end wall portions configured at an angle to provide a wedge shape intruding into the ink manifold.

40. The print head of claim 30 wherein the periphery of the ink manifold has opposed major edges, each defining an array of extending chambers, each chamber encompassing a respective ink energizing element.

41. The ink jet print head of claim 30 further comprised of an orifice-barrier layer.

* * * * *

UNITED STATES PATENT AND TRADEMARK OFFICE

CERTIFICATE OF CORRECTION

PATENT NO. : 6,132,033
DATED : October 17, 2000
INVENTOR(S) : Robert N. K. Browning et al.

It is certified that error appears in the above-identified patent and that said Letters Patent is hereby corrected as shown below:

Column 10,
Line 16, "let" should read -- jet --.

Signed and Sealed this

Fourth Day of March, 2003

JAMES E. ROGAN
*Director of the United States Patent and Trademark Office*